US005690480A

United States Patent [19]

Suzuki et al.

[11] Patent Number: 5,690,480

[45] Date of Patent: Nov. 25, 1997

[54] SCROLL COMPRESSOR WITH COOLING HOLES IN ORBITING SCROLL

[75] Inventors: Akira Suzuki; Kazuaki Shiinoki; Isamu Kawano, all of Shimizu; Shigeru Machida, Ibaraki-ken, all of Japan

[73] Assignee: Hitachi, Ltd., Tokyo, Japan

[21] Appl. No.: 602,275

[22] Filed: Feb. 16, 1996

[30] Foreign Application Priority Data

Feb. 20, 1995 [JP] Japan ..... 7-030395
Mar. 20, 1995 [JP] Japan ..... 7-060469

[51] Int. Cl.[6] ..... F01C 1/04

[52] U.S. Cl. ..... 418/55.2; 418/55.3; 418/86; 418/101

[58] Field of Search ..... 418/55.1, 55.2, 418/55.3, 86, 101

[56] References Cited

U.S. PATENT DOCUMENTS 5,258,046 11/1993 Haga et al. ..... 418/55.2
5,356,276 10/1994 Spinnler ..... 418/55.2
5,556,269 9/1996 Suzuki et al. ..... 418/55.2

FOREIGN PATENT DOCUMENTS 561212 9/1993 European Pat. Off. ..... 418/55.2
63-123788 8/1988 Japan .
63-125188 8/1988 Japan .
5-87285 11/1993 Japan .

*Primary Examiner*—Charles G. Freay
*Attorney, Agent, or Firm*—Fay, Sharpe, Beall, Fagan, Minnich & McKee

[57] ABSTRACT

An end plate 3*a* of an orbiting scroll 3 of an oil-less scroll compressor is provided with cooling holes 7 passing from the periphery of the revolving scroll through the central portion thereof. Using a pressure difference of about 100 mmAq between the ends of the cooling holes 7, the scroll compressor's own intake air is passed through the cooling holes to directly cool the revolving scroll.

20 Claims, 12 Drawing Sheets

SCROLL COMPRESSOR WITH COOLING HOLES IN ORBITING SCROLL

BACKGROUND OF THE INVENTION

This invention relates to a scroll compressor used as an air compressor or a compressor for refrigeration or air-conditioning, and particularly to a scroll compressor of a structure having double laps suitable for realizing a large scroll compressor which compresses a gas without lubrication and is suitable for general industrial use, that is, fields such as the food industry, medical product manufacturing, clean rooms for manufacturing semiconductor devices, and air carrying equipment.

As in an oil-less scroll compressor disclosed in Japanese Unexamined Utility Model Publication No. S.63-125188, as a cooling method of a conventional scroll compressor, a method wherein cooling fins are provided on the fixed scrolls and the scrolls are cooled from their outer sides has been employed.

However, with a large oil-less type scroll compressor for compressing air having a delivery pressure of 0.7 to 0.85 MPa, in the case of a conventional type of oil-less type scroll compressor not having a cooling medium in the compression process, when only outside cooling byway of the fixed scrolls is used the delivery air temperature reaches a high temperature of about 200° C. As a result, unless the radial gaps and thrust gaps between the revolving scroll and the fixed scrolls are both made large in anticipation of thermal expansion of the revolving scroll and the fixed scrolls during running, the laps of the scrolls come into contact during compressor running, and there has been the problem that because the gaps at the time of assembly thus become large, the performance of the compressor is reduced. Also, in an oil-less type scroll compressor, usually tip seals are provided on the end surfaces of the laps of the scrolls to prevent leakage of compressed gas. A tetrafluoroethylene resin is normally used as the material for these tip seals, but because during compressor running they are exposed to high-temperature conditions of about 200° C., there has been the problem that the life of the seals has been short.

SUMMARY OF THE INVENTION

An object of the invention is to provide a scroll compressor with which it is possible to cool an orbiting or revolving scroll effectively.

Another object of the invention is to provide a scroll compressor with which it is possible to make radial gaps and thrust gaps between an orbiting or revolving scroll and fixed scrolls small and thereby improve the performance of the compressor.

Another object of the invention is to provide a scroll compressor with which it is possible to increase the life span with respect to wear of tip seals provided on the ends of scroll laps.

Another object of the invention is to provide a scroll compressor with which it is possible to cool the orbiting or revolving scroll directly with low-temperature intake air.

Another object of the invention is to provide a scroll compressor with which it is possible to reduce the delivery temperature of the compressor and thereby facilitate cooling of the delivery air and improve the reliability of the compressor.

Another object of the invention is to provide a scroll compressor with which it is possible to reduce loads acting on the tip seals and thereby increase their life by balancing thrust forces acting on the revolving scroll of an oil-less type double scroll compressor.

The invention was devised on the basis of the above-mentioned objects, and provides a scroll compressor wherein cooling holes through which Gas flows are formed in the mirror or end plate (trunk plate) of an orbiting or revolving scroll and particularly the high-temperature parts (near a delivery port) of the revolving scroll are directly cooled by this gas. In particular, in the invention, the compressor's own intake air is made to flow through the cooling holes by a pressure difference across the revolving scroll and the revolving scroll is thereby directly cooled by low-temperature outside air.

That is, a first aspect of the invention provides a scroll compressor comprising an orbiting or revolving scroll capable of revolving without autorotating having a spiral-shaped lap formed on a mirror or end plate and a fixed scroll having a spiral-shaped lap meshing with the lap formed on the mirror plate, characterized in that the mirror plate has a cooling hole passing through the mirror plate from one peripheral side of the mirror plate to another and at least some of the intake gas of the scroll compressor passes through the cooling hole before being sucked into a compression chamber through an intake end of the spiral-shaped laps.

A second aspect of the invention provides a scroll compressor comprising an orbiting or revolving scroll having a lap surface on either side of a mirror plate, a fixed scroll disposed on either side of the revolving scroll and a drive shaft (crankshaft) and an auxiliary crankshaft for revolving the revolving scroll rotatably supported by the fixed scrolls, characterized in that the mirror plate has a cooling hole passing through the mirror plate from one peripheral side of the mirror plate to another through which at least some of the intake Gas of the scroll compressor passes.

A third aspect of the invention provides a scroll compressor comprising a revolving scroll having a spiral-shaped lap disposed on either side of a mirror plate, left and right fixed scrolls disposed on either side of the scroll compressor and each having a spiral-shaped lap meshing with a lap of the revolving scroll, a drive shaft and an auxiliary crankshaft for revolving the revolving scroll and rotatably supported by the left and right fixed scrolls byway of bearings and a timing belt for causing the drive shaft and the auxiliary crankshaft to rotate synchronously, characterized in that the mirror plate has a cooling hole passing through the mirror plate from one peripheral side of the mirror plate to another through which at least some of the intake gas of the scroll compressor passes and there are provided cooling fins formed on outer surfaces of the left and right fixed scrolls extending in a direction connecting the drive shaft and the auxiliary crankshaft and a cooling fan for causing a cooling medium to flow over the cooling fin.

A fourth aspect of the invention provides a scroll compressor comprising: a scroll compressor proper having a revolving scroll having a lap surface on either side of a mirror plate, a fixed scroll disposed on either side of the revolving scroll and a drive shaft and an auxiliary crankshaft for revolving the revolving scroll and rotatably supported by the fixed scrolls; a motor for driving the scroll compressor member by way of a V-belt; a starting plate or controller for controlling the motor; a delivery pipe for guiding gas discharged from the scroll compressor member to the outside and, disposed in the delivery pipe in the following order from the upstream side, a nonreturn valve, a precooler and an aftercooler; a cooling fan for cooling said equipment; and a casing for housing said equipment, characterized in that the mirror plate has a cooling hole passing through the mirror plate from one peripheral side of the mirror plate to another and at least some of the intake gas of the scroll compressor passes through the cooling hole before being sucked into a compression chamber through an intake end of the spiral-shaped laps.

A fifth aspect of the invention provides a scroll compressor comprising an orbiting or revolving scroll having a lap surface on either side of a mirror plate, a fixed scroll disposed on either side of the revolving scroll and a drive shaft and an auxiliary crankshaft for revolving the revolving scroll and rotatably supported by the fixed scrolls, characterized in that the mirror plate has a connecting hole formed near the center thereof for connecting together compression chambers formed on either side of the mirror plate and a cooling hole passing through the mirror plate from one peripheral side of the mirror plate to another through which at least some of the intake gas of the scroll compressor passes.

A sixth aspect of the invention provides a scroll compressor comprising an orbiting revolving scroll having a lap surface on either side of a mirror plate, a fixed scroll disposed on either side of the revolving scroll and a drive shaft and an auxiliary crankshaft for revolving the revolving scroll and rotatably supported by the fixed scrolls, characterized in that the mirror plate has a connecting hole formed near the center thereof for connecting together compression chambers formed on either side of the mirror plate and a cooling hole passing through the mirror plate from one peripheral side of the mirror plate to another through which at least some of the intake gas of the scroll compressor passes, and there is provided a partition for separating an intake space at an inlet end of the cooling hole and an intake space at an outlet end of the cooling hole.

A seventh aspect of the invention provides a double scroll compressor, for compressing a fluid sucked in through an inlet port by means of eccentric motion of an orbiting or revolving scroll, comprising a revolving scroll having a lap surface on either side of a mirror plate, a fixed scroll disposed on either side of the revolving scroll and a drive shaft and an auxiliary crankshaft for revolving the revolving scroll and rotatably supported by the fixed scrolls, characterized in that the mirror plate (trunk plate) has a cooling hole passing through the mirror plate from one peripheral side of the mirror plate to another through which at least some of the intake gas of the scroll compressor passes.

An eighth aspect of the invention provides an orbiting or revolving scroll having a lap surface on either side of a mirror plate, a fixed scroll disposed on either side of the revolving scroll and a drive shaft and an auxiliary crankshaft for revolving the revolving scroll and rotatably supported by the fixed scrolls, characterized in that the mirror plate has a cooling hole passing through the mirror plate in a transverse direction through which at least some of the intake gas of the scroll compressor passes, and there is provided a partition for separating an intake space at an inlet end of the cooling hole and an intake space at an outlet end of the cooling hole.

Further benefits can be obtained in the following ways:

(1) By the mirror plate having a plurality of pressure-equalizing holes for connecting together compression chambers formed on either side of the mirror plate and balancing thrust forces of gas pressures inside the compression chambers.

(2) By tip seals being provided on end portions of the spiral-shaped laps of the fixed and revolving scrolls.

(3) By the cooling holes passing through the vicinity of a central portion of the revolving scroll which reaches the highest temperature.

(4) By the cross-sectional shape of the cooling holes being made a chrysanthemum shape.

(5) By the mirror plate having a plurality of cooling holes provided in parallel or by the mirror plate having a plurality of longitudinal cooling holes provided in parallel in a longitudinal direction and a plurality of transverse cooling holes connecting together the longitudinal cooling holes provided in a transverse direction.

(6) By the mirror plate having a plurality of cooling holes formed diagonally rising to the right and a plurality of cooling holes formed diagonally rising to the left so provided that they mutually intersect and mutually connect where they intersect.

A scroll compressor performs compression by means of an eccentric motion of a revolving scroll with respect to a fixed scroll. To give this eccentric motion to the revolving scroll, crankshafts are used. Revolving of the revolving scroll causes a compression space between the revolving scroll and the fixed scroll to gradually become smaller, compressing a gas in the space. In this compression process, the gas being compressed gradually rises in temperature and along with this the fixed scroll and the revolving scroll themselves also rise in temperature from their peripheries toward their centers. This compression heat can be removed indirectly by means of cooling fins provided on the outside of the fixed scroll to radiate heat to outside the scroll compressor. In this way the fixed scroll part can be cooled, but it is not possible to cool the revolving scroll well by means of such cooling fins. To solve this problem, in this invention, a plurality of cooling holes are formed in the mirror plate (trunk plate) of the revolving scroll. That is, preferably, cooling holes are provided passing through the central part of the revolving scroll from one peripheral side of the revolving scroll to the other; these cooling holes are formed so that they have one end near an inlet port through which intake gas is drawn into the scroll compressor and the other end near an intake side end of a compression chamber, and consequently some of intake air entering the compressor passes through the cooling holes as a result of a pressure difference across the ends of the cooling holes. That is, intake air of the compressor flows through the cooling holes from a position near the inlet port toward a lower pressure part of the intake stream and directly cools the revolving scroll as it does so. As a result, particularly high-temperature parts of the revolving scroll near a discharge port are cooled, thermal expansion of the central part of the revolving scroll is reduced and the delivery air temperature is reduced, contact between the revolving scroll and the fixed scroll is prevented and it is possible to improve the performance and reliability of the compressor.

Other characteristics and objects and benefits of the invention will be made clear by the following detailed description of preferred embodiments thereof made with reference to the accompanying drawings.

DETAILED DESCRIPTION OF THE PREFERRED EMBODIMENTS

Preferred embodiments of the invention will now be described with reference to the accompanying drawings.

Figure 12:
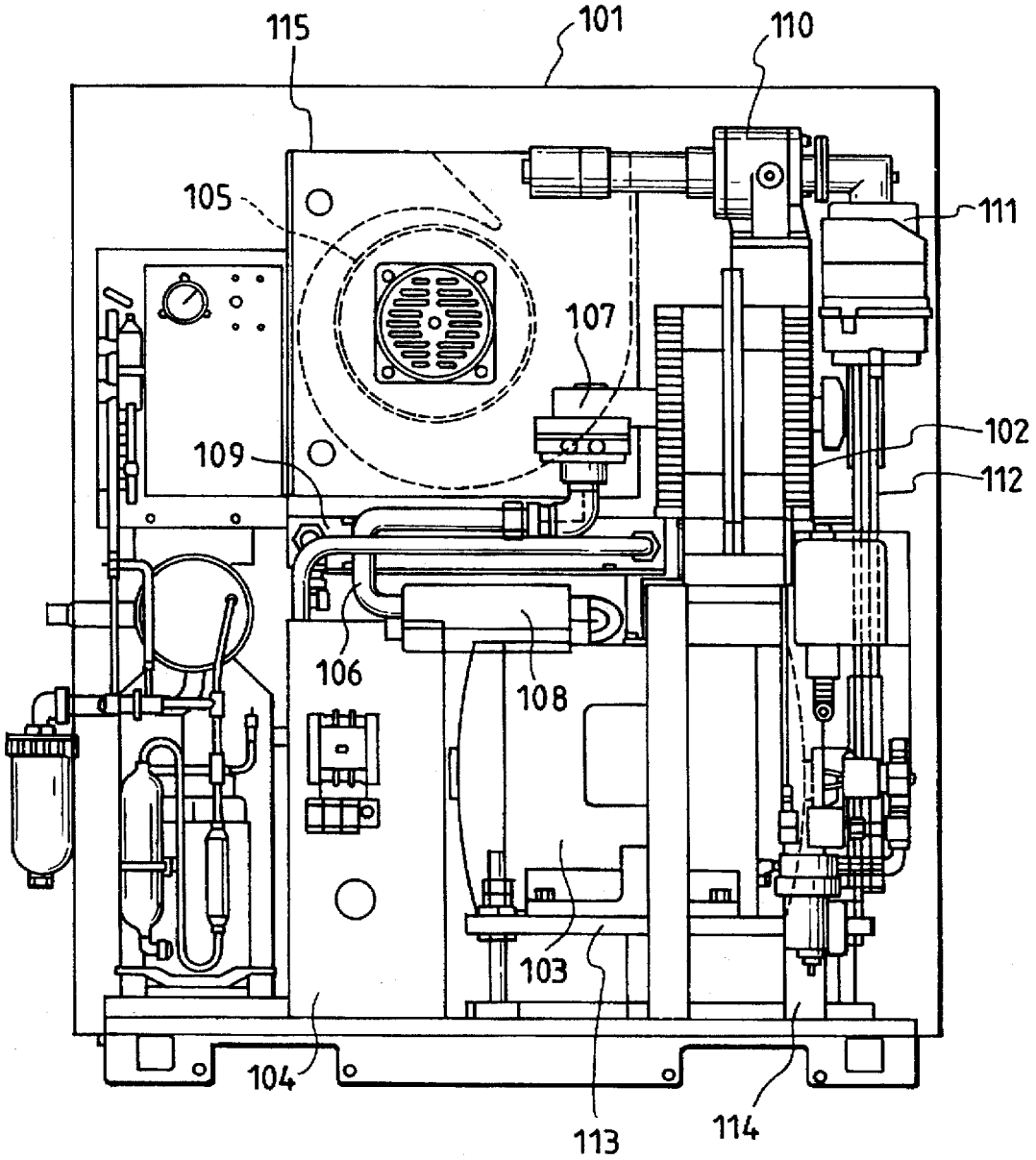
FIG. 12 is a view illustrating the overall construction of a scroll compressor.

First, the overall construction of a scroll compressor according to the invention used as an air compressor will be described with reference to FIG. 12. In FIG. 12, reference numeral 101 denotes a casing, and inside this casing 101 are mounted a compressor member block (compressor) 102 of a double scroll compressor, a motor 103 for driving this scroll compressor byway of a V-belt 112, a starting plate or controller 104 for controlling the motor and a cooling fan 105 for cooling the equipment inside the casing 101. Discharge gas from the compressor 102 is guided to the outside through a delivery pipe 106, and in this delivery pipe 106 there are provided, in order from the upstream side, a nonreturn valve 107, a precooler 108 and an aftercooler 109. In FIG. 12, reference numeral 110 denotes an unloader, 111 a suction filter provided in an intake pipe, 113 a motor base, 114 a frame supporting the motor 103 and the compressor 102, and 115 a fan casing.

A first preferred embodiment of the invention will now be described with reference to FIG. 1 through FIG. 5.

Figure 1:
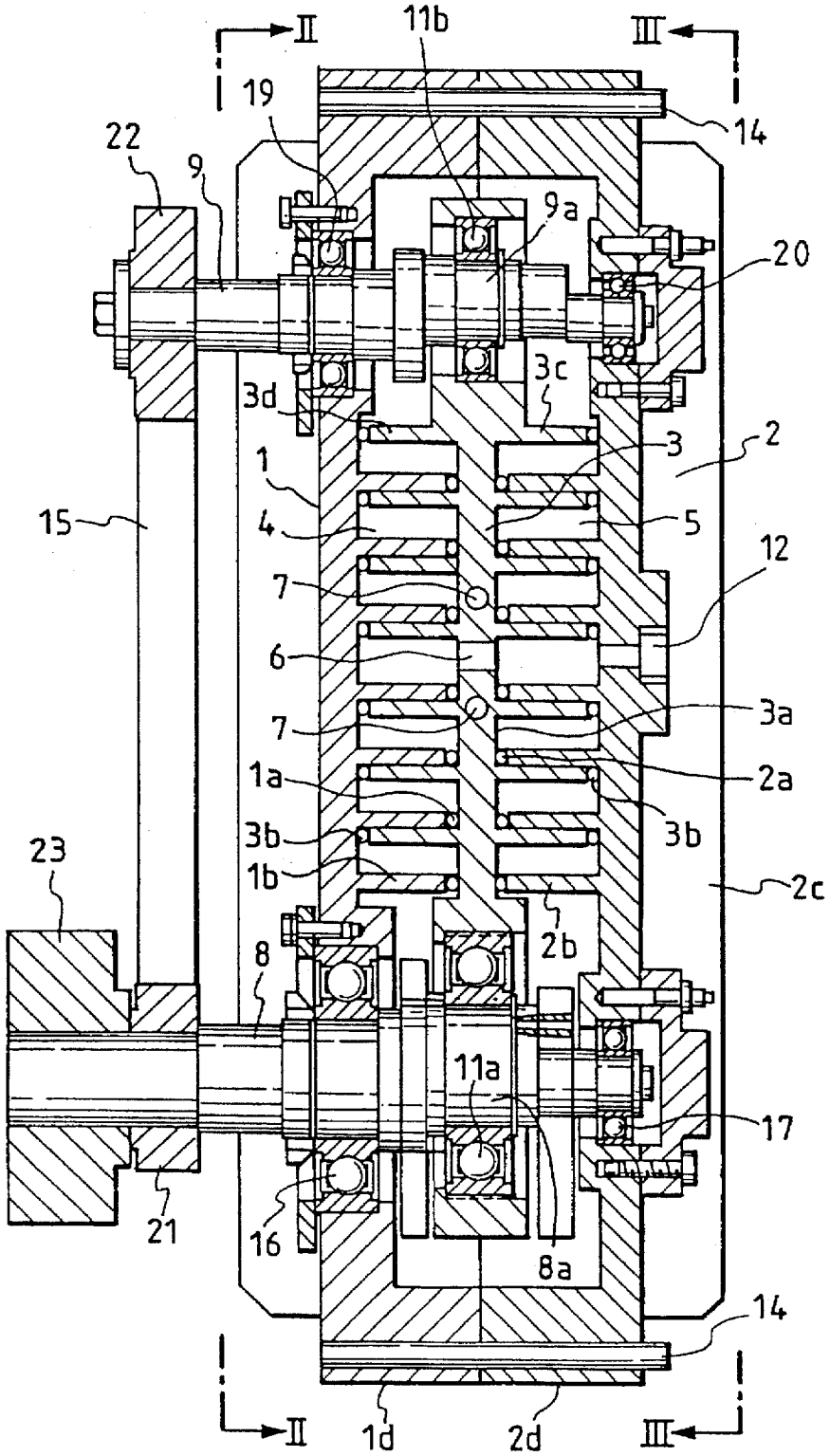
FIG. 1 is a plan sectional view of the structure of a compressor member block part of a preferred embodiment of a double scroll oil-less scroll compressor according to the invention.
Figure 2:
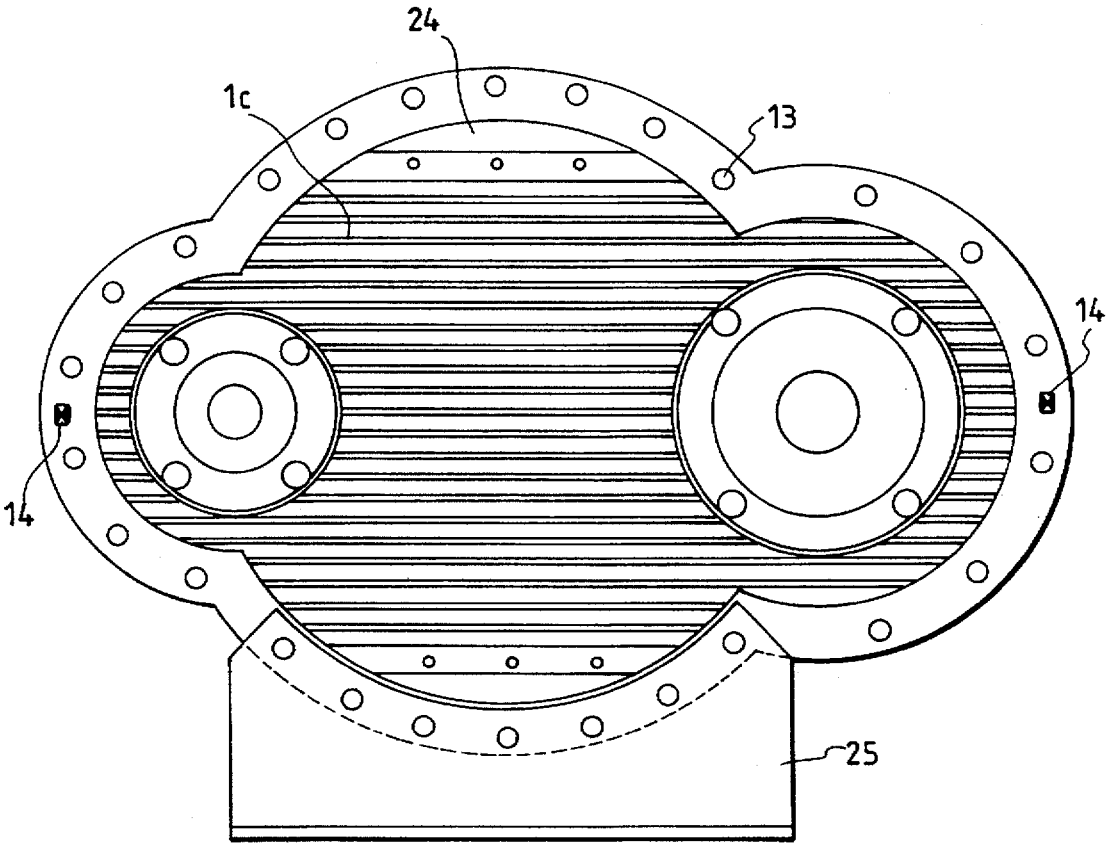
FIG. 2 is a view in the direction of the arrows II—II in FIG. 1.
Figure 3:
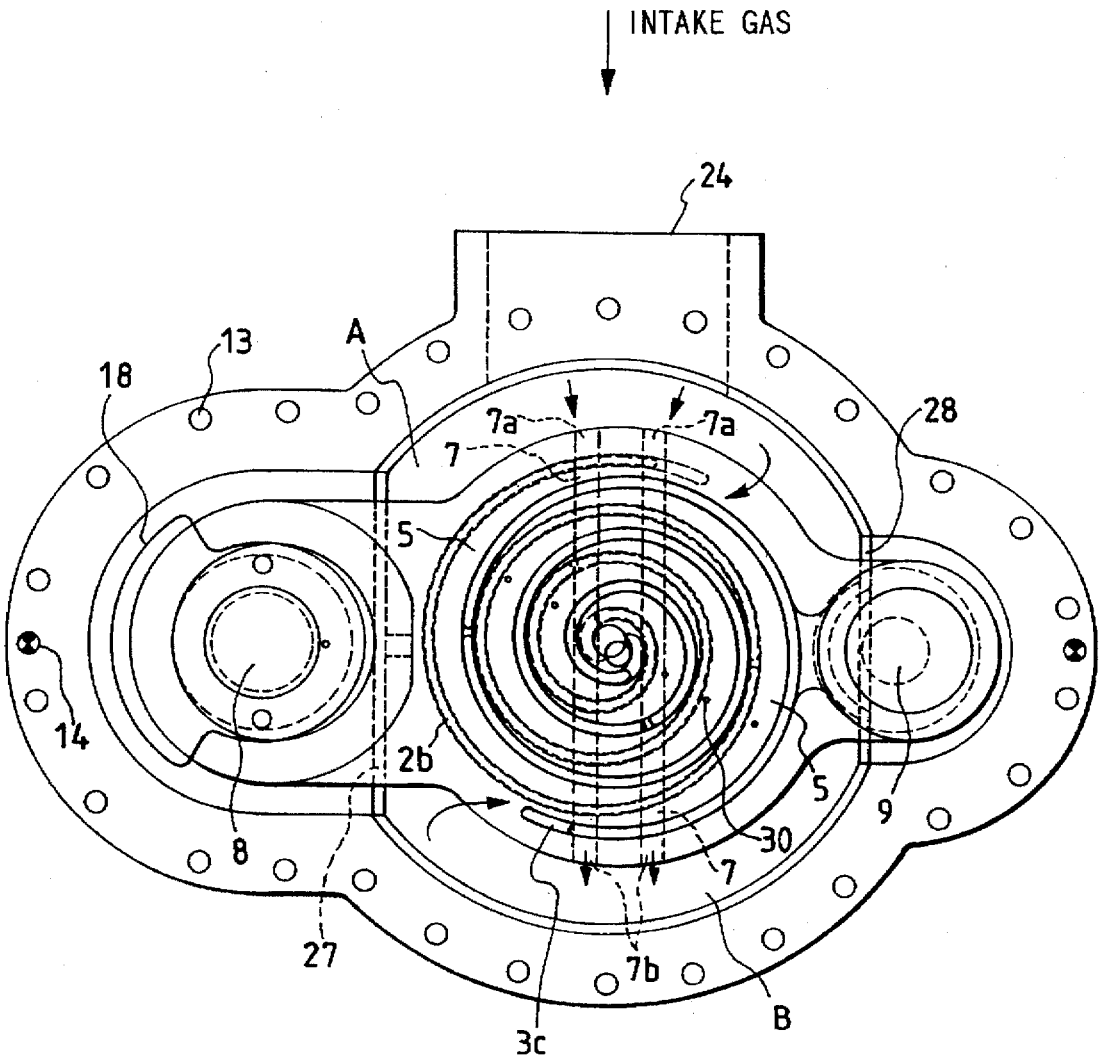
FIG. 3 is a right side view in the direction of the arrows III—III in FIG. 1 with a right side fixed scroll of the compressor removed.
Figure 4:
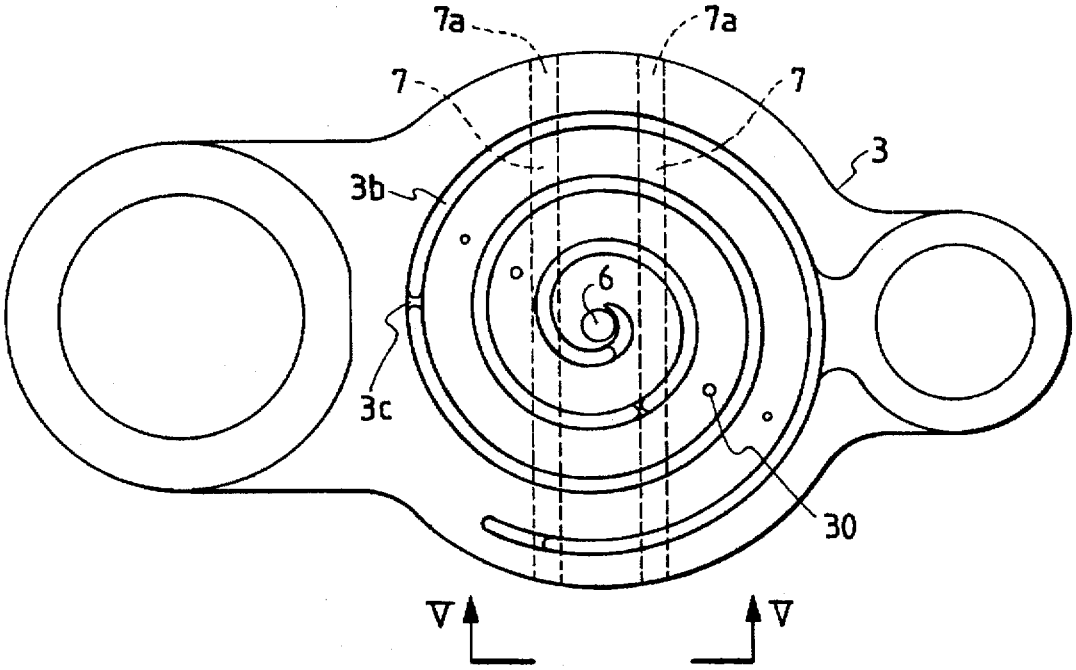
FIG. 4 is a right side view of a revolving scroll shown in FIG. 1.
Figure 5:
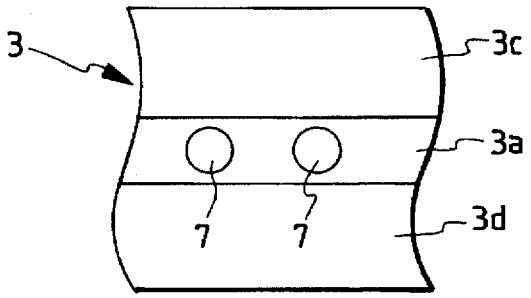
FIG. 5 is a view in the direction of the arrows V—V in FIG. 4.

FIG. 1 is a sectional view of a compressor member block part of a preferred embodiment of a double scroll oil-less scroll compressor according to the invention, FIG. 2 is a view in the direction of the arrows II—II in FIG. 1, FIG. 3 is a right side view in the direction of the arrows III—III of FIG. 1 with a right side fixed scroll removed, FIG. 4 is a right side view of a revolving scroll shown in FIG. 1 and FIG. 5 is a view in the direction of the arrows V—V of FIG. 4.

In FIG. 1, reference numerals 1 and 2 denote fixed scrolls made of an aluminum alloy; these fixed scrolls 1 and 2 are disposed in parallel with each other, an orbiting or revolving scroll 3 also made of an aluminum alloy is interposed between the fixed scrolls 1 and 2 and spiral-shaped laps **1*b* and 2*b* of the fixed scrolls 1 and 2 mesh with spiral-shaped laps 3*c* and 3*d* of the revolving scroll 3, whereby compression chambers 4 and 5 are formed on either side of a mirror or end plate (trunk plate) 3*a* of the revolving scroll 3. Tip seals 1*a*, 2*a* and 3*b* are provided on the end surfaces of the laps of the fixed scrolls 1 and 2 and the revolving scroll 3. These tip seals are made for example of a compound material of an inorganic material such as carbon, tetrafluoroethylene resin or polyamide resin. A connecting hole 6 connecting the compression chambers 4 and 5 is provided in the central portion of the mirror or end plate 3*a* of the revolving scroll 3, and cooling holes 7 passing through the mirror plate 3*a* of the revolving scroll 3 from one peripheral side of the revolving scroll 3 to the other are formed on either side of this connecting hole 6 as shown in FIG. 3 through FIG. 5 so that some intake air passes through these cooling holes 7** to the intake side on the other side of the scroll compressor.

A drive shaft (crankshaft) 8 having a crank part **8*a* and an auxiliary crankshaft 9 having a crank part 9*a* of the same eccentricity as the crank part 8*a* are disposed passing through the end portions of the mirror plate 3*a* of the revolving scroll 3, and the revolving scroll 3 is revolvably mounted on these crank parts 8*a* and 9*a* by way of roller bearings 11*a* and 11*b* having elastic support parts. The fixed scroll 2 has a delivery port 12 in the central portion thereof, radiating fins 1*c* and 2*c* are provided over the entire outer surfaces of the fixed scrolls 1 and 2, flange portions 1*d* and 2*d* are provided around the peripheral portions of the fixed scrolls 1 and 2, and as shown in FIG. 2 and FIG. 3 these flange portions 1*d* and 2*d* of the fixed scrolls 1 and 2 are joined together with bolts 13. When this joining is carried out, before the flange portions 1*d* and 2*d* are joined together with the bolts 13, the two fixed scrolls 1 and 2 are positioned with respect to each other using positioning means 14 such as knock pins. Also, the revolving scroll 3 is correctly positioned with respect to the fixed scrolls 1 and 2 and then with the drive shaft 8 and the auxiliary crankshaft 9 correctly in phase and the two shafts 8 and 9 are connected by a timing belt 15 so that they rotate synchronously. This timing belt 15 passes around pulleys 21 and 22 mounted on the drive shaft 8 and the auxiliary crankshaft 9 respectively. Rotational power is supplied from a drive source such as a motor to the drive shaft 8 byway of the V-belt 112 and a pulley 23**.

The drive shaft 8 is supported fixed in its axial direction by a roller bearing (load side bearing) 16 mounted in the fixed scroll 1, and the end of the drive shaft 8 on the fixed scroll 2 side is supported by a bearing (non-load side bearing) 17 mounted in the fixed scroll 2. Also, a balance weight 18 is mounted on the drive shaft 8 so that it is disposed in the intake atmosphere of the scroll compressor. The auxiliary crankshaft 9 also is supported fixedly positioned in its axial direction by a roller bearing (load side bearing) 19 mounted in the fixed scroll 1 and has its end on the fixed scroll 2 side supported by a bearing (non-load side bearing) 20 mounted in the fixed scroll 2.

An inlet port 24 is provided extending over both the fixed scrolls in a direction orthogonal to the shafts 8 and 9 as shown in FIG. 3. Also, a stand part 25 is mounted on the opposite, lower side, as shown in FIG. 2.

As described above, the fixed scrolls 1 and 2 and the revolving scroll 3 are preferably made of a light material having good thermal conductivity, as typified by aluminum alloy. When the scroll compressor is made of oil free type, an aluminum alloy containing silicon is preferably used. Also, to increase the lubricity of the contacting lap surfaces, a surface treatment such as formation of an anodic oxide film may also be carried out.

As shown in FIG. 3, the cooling holes 7 formed in the mirror plate 3*a* of the revolving scroll 3 pass through from one side (the intake side at the outer end of the lap 2*b* of the fixed scroll 2) A to the other side (the intake side at the outer ends of the laps 3*c* and 3*d* of the revolving scroll 3) B of the revolving scroll 3, and so that most of the air taken in from the intake side B passes through the cooling holes 7. Partitions 27 and 28 are provided in the intake spaces of the fixed scrolls so as to separate the intake spaces A and B from each other. By means of this construction, as shown in FIG. 3, some of the intake air passes through the cooling holes 7 before being sucked into one intake side of the scroll compressor, and as a result the scroll compressor is cooled using its own intake air.

Because an oil-less scroll compressor has no cooling medium such as oil in the compression chambers so that clean compressed gas can be obtained, even at a delivery pressure of about 0.7 to 0.8 MPa compression heat produced in the compression chambers causes the temperature of the compression chambers to rise to about 200° C. To remove this compression heat the radiating fins 1*c* and 2*c* are provided on the outer surfaces of the left fixed scroll 1 and the right fixed scroll 2 and cooling is effected by compression heat being removed from the radiating fins 1*c* and 2*c* by cooling air forcibly blown over the radiating fins 1*c* and 2*c* by means of a cooling fan 105 (FIG. 12). Meanwhile, in this preferred embodiment, because there are provided at least two cooling holes 7 passing vertically (in the same direction as the inlet port 24) through the mirror plate 3*a* of the revolving scroll 3 on either side of the connecting hole 6, the scroll compressor is also cooled from the inside. The cooling holes 7 pass through the central part of the revolving scroll 3, which is the part that reaches the highest temperature.

As shown in FIG. 3, the spaces on either side of the revolving scroll 3 are intake spaces A and B of the scroll compressor through which air taken in through the inlet port 24 flows. Air at the cooling outlet 7*b* ends of the cooling holes 7 is at a slightly lower pressure (about 100 mmAq lower) than air at the cooling inlet 7*a* ends of the cooling holes 7. Using this 100 mmAq pressure difference, intake air is drawn through the cooling holes 7 before being sucked into the compression chambers from the intake side B. Because this air passing through the cooling holes 7 is outside air it is at a much lower temperature than the temperature of the delivery gas of the scroll compressor, and this cool air exchanges heat with parts of the revolving scroll 3 made hot by compression heat and cools these parts of the revolving scroll 3.

With every revolution of the revolving scroll 3, gas sucked in through the inlet port 24 is sucked in between the surfaces of the laps of the revolving scroll 3 and the fixed scrolls 1 and 2, pressurized to a predetermined pressure and discharged through the delivery port 12. The drive system for revolving the revolving scroll 3 operates as follows: First, driving power is transmitted from a driving power source 103 such as a motor to the pulley 23 and rotates the drive shaft 8. The drive shaft 8 is supported by the load side roller bearing 16 and the non-load side roller bearing 17 and revolves the revolving scroll 3 byway of the crank bearing 11*a* mounted in the mirror plate 3*a*. The crank bearing 11*a* supports a gas load produced by the compression of the air in the compression chambers 4 and 5. The auxiliary crankshaft 9 is rotated by the timing belt 15 synchronously with the drive shaft 8. The auxiliary crankshaft 9 is supported by the load side roller bearing 19 and the non-load side roller bearing 20, and together with the drive shaft 8 drives the revolving scroll 3 by way of the roller bearing 11*b* mounted on the crank part 9*a*.

When rotational power is transmitted to the pulley 23, the drive shaft 8 rotates and the auxiliary crankshaft 9 is rotated by the timing belt 15 synchronously with the drive shaft 8, and as a result the revolving scroll 3 goes through a revolving motion of a radius equal to the eccentricity of the crank parts 8*a* and 9*a* of the shafts 8 and 9. Along with this revolving motion, outside air is sucked in through the inlet port 24 and enters the intake chamber (intake space) A. After that, this air flows into the compression chambers 4 and 5 formed by the revolving scroll 3 and the fixed scrolls 1 and 2 and is compressed to a predetermined pressure. Air compressed in the compression chambers 4 and 5 is discharged through the delivery port 12, or, more specifically, air compressed in the compression chamber 4 on the opposite side of the mirror plate 3*a* from the delivery port 12 flows through the connecting hole 6 provided in the central portion of the mirror plate 3*a* into the compression chamber 5 on the other side of the mirror plate 3*a* and is discharged from the compressor through the delivery port 12 provided in the fixed scroll 2 together with air already in the compression chamber 5.

Because there is almost no lubricating oil in the compression chambers, the compressed gas becomes hotter than in an equivalent oil-cooled compressor; however, by the radiating fins 1*c* and 2*c* provided on the outer surfaces of the fixed scrolls being forcibly air-cooled by air blown through ducts provided around the radiating fins 1*c* and 2*c*, the cooling effect can be increased.

In FIG. 3 and FIG. 4, reference numeral 30 denotes pressure-equalizing holes for maintaining a pressure balance between the compression chambers 4 and 5 formed on either side of the revolving scroll 3, and in the double scroll of this invention, because the thrust forces of the gas in the compression chambers 4 and 5 on either side of the mirror plate 3*a* are substantially equalized by these pressure-equalizing holes 30, large thrust loads do not act on the tip seals 1*a*, 2*a* and 3*b* on the end surfaces of the laps 1*b*, 2*b*, 3*c* and 3*d*. As a result, sliding losses at the ends of the laps can be kept to a minimum. Also, because the thrust forces acting on the revolving scroll 3 are substantially balanced, a positioning means used to position the roller bearings 11*a* and 11*b* supporting the revolving scroll 3 can be simplified and the assemblability of the scroll compressor can be improved.

Some of the benefits provided by the preferred embodiment described above are as follows:

(1) Because not only can the fixed scrolls 1 and 2 be cooled from the outside by means of the radiating fins 1*c* and 2*c* but also the revolving scroll 3 disposed inside the compressor can be directly cooled by means of the cooling holes 7, it is possible to reduce the temperature of the central portion of the revolving scroll by about 30° C. compared to a conventional scroll compressor. Consequently it is possible to make the gaps formed between the fixed scrolls and the revolving scroll smaller, and as a result the compressor performance can be improved by 3 to 5%.

(2) It is possible to reduce the discharge air temperature of the compressor, cooling of the delivered air becomes easy and the reliability of the compressor can be increased.

(3) Because it is also possible to lower the temperature of tip seals provided on the ends of the laps of an oil-less double scroll compressor by about 30° C. compared to a conventional compressor, selection of the material of the tip seals becomes easier and their life with respect to wear can be increased. In particular, in this preferred embodiment, because the mirror plate 3*a* of the revolving scroll 3 is provided with pressure-equalizing holes 30 for connecting the compression chambers 4 and 5 on either side of the mirror plate 3*a*, the thrust forces acting on the revolving scroll 3 are balanced better, the loads acting on the tip seals are therefore reduced and their life is extended in this way also.

Various modification examples of the invention will now be described with reference to FIG. 6 through FIG. 11.

Figure 6:
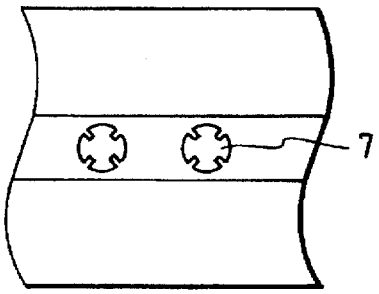
FIG. 6 is a view corresponding to FIG. 5 showing a modification example of a shape of cooling holes 7 formed in a mirror plate of the revolving scroll.

FIG. 6 shows cooling holes 7 formed in a mirror plate of a revolving scroll of which the cross-section has been made chrysanthemum-shaped instead of round like the holes shown in FIG. 5; by doing this it is possible to increase the heat-exchanging surface area of the cooling holes and thereby increase the cooling effect of the holes.

Figure 7:
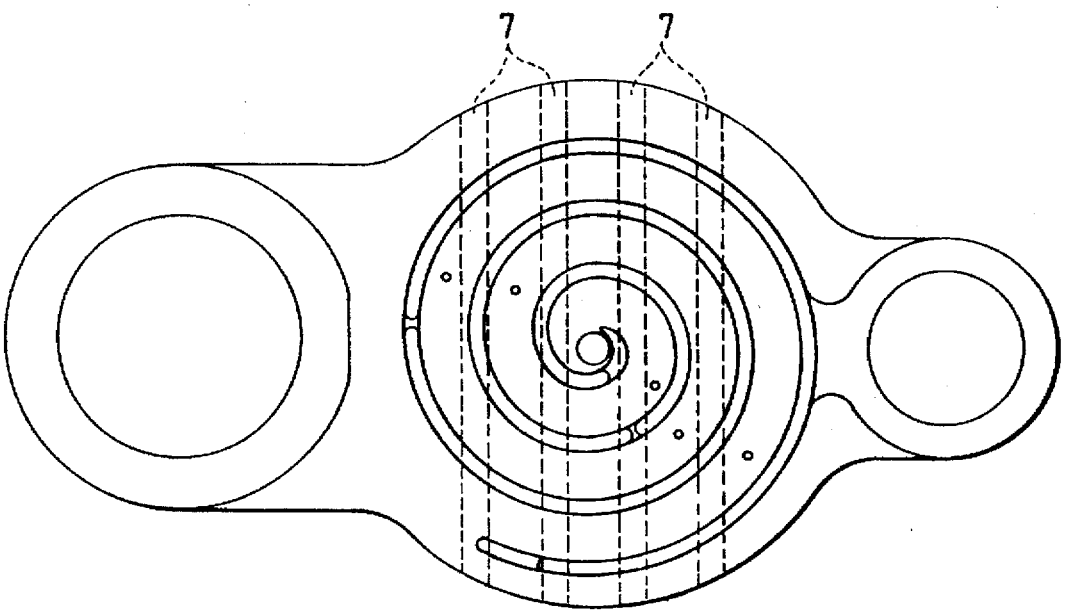
FIG. 7 is a view corresponding to FIG. 4 showing a modification example of cooling holes formed in the mirror plate of the revolving scroll.

FIG. 7 shows a revolving scroll wherein the number of the cooling holes 7 formed in the mirror plate 3*a* of the revolving scroll 3 is increased to four from the two shown in FIG. 4 whereby the passage surface area of the cooling holes 7 through which intake air passes is increased, the passage resistance is reduced, the amount of air flowing through the cooling holes 7 is increased and the cooling effect is therefore increased, and cooling is carried out throughout the whole revolving scroll. By making the passage surface areas of the cooling holes near the central portion of the revolving scroll greater than those of the cooling holes formed on the outer sides of these, cooling can be provided in proportion with the amount of heat produced in different parts of the revolving scroll.

Figure 8:
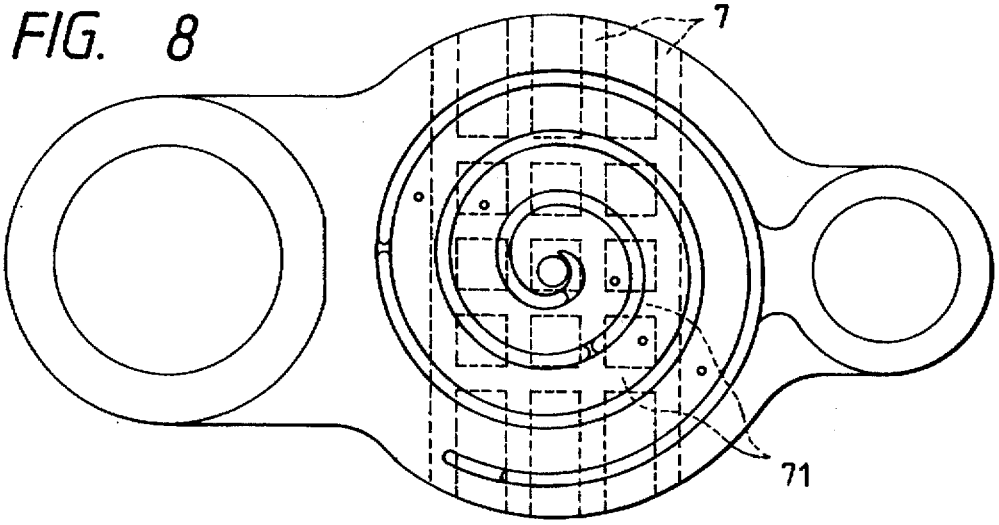
FIG. 8 is a view corresponding to FIG. 4 showing a another modification example of cooling holes formed in the mirror plate of the revolving scroll.

FIG. 8 shows a revolving scroll wherein four cooling holes 7 are provided in the vertical direction (the vertical direction in the drawing; the inlet ends of the cooling holes 7 being near the inlet port 24) as in FIG. 7 and there are also provided four transverse direction (horizontal) cooling holes 71 formed so as to connect these cooling holes 7 together.

Figure 9:
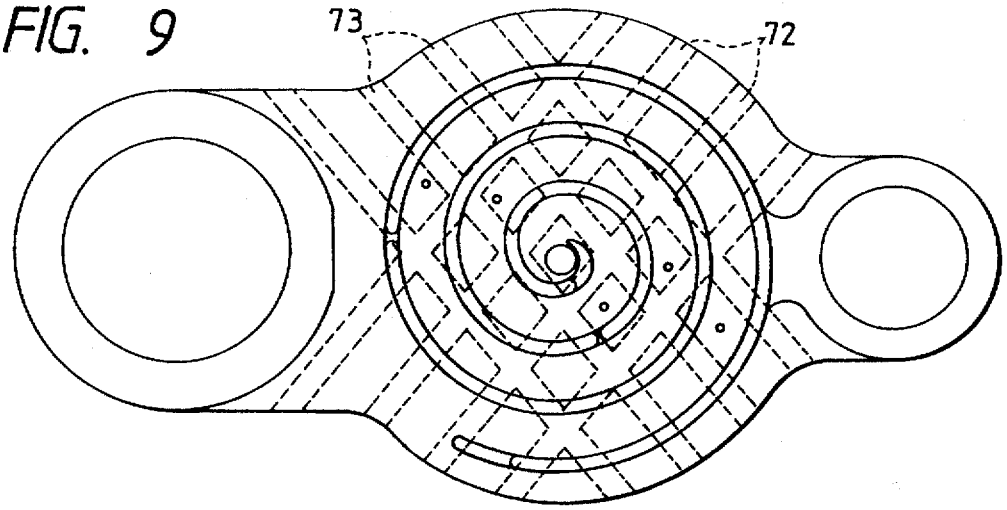
FIG. 9 is a view corresponding to FIG. 4 showing another modification example of cooling holes formed in the mirror plate of the revolving scroll.

FIG. 9 shows a revolving scroll wherein a plurality of cooling holes 72 formed diagonally rising to the right and a plurality of cooling holes 73 formed diagonally rising to the left are provided so as to intersect with each other and connect to each other at these intersections.

By adopting the constructions shown in FIG. 8 and FIG. 9, more uniform cooling is possible.

Figure 10:
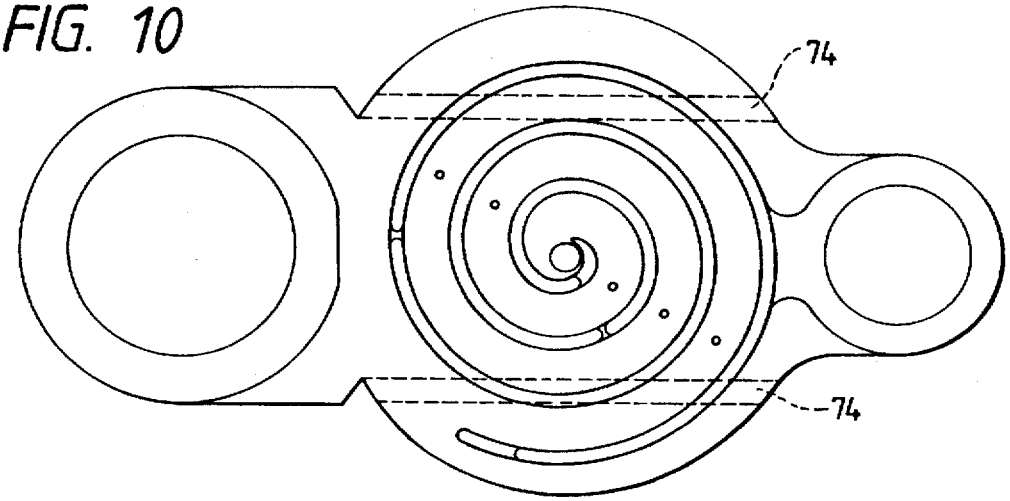
FIG. 10 is a view corresponding to FIG. 4 showing another modification example of cooling holes formed in the mirror plate of the revolving scroll.
Figure 11:
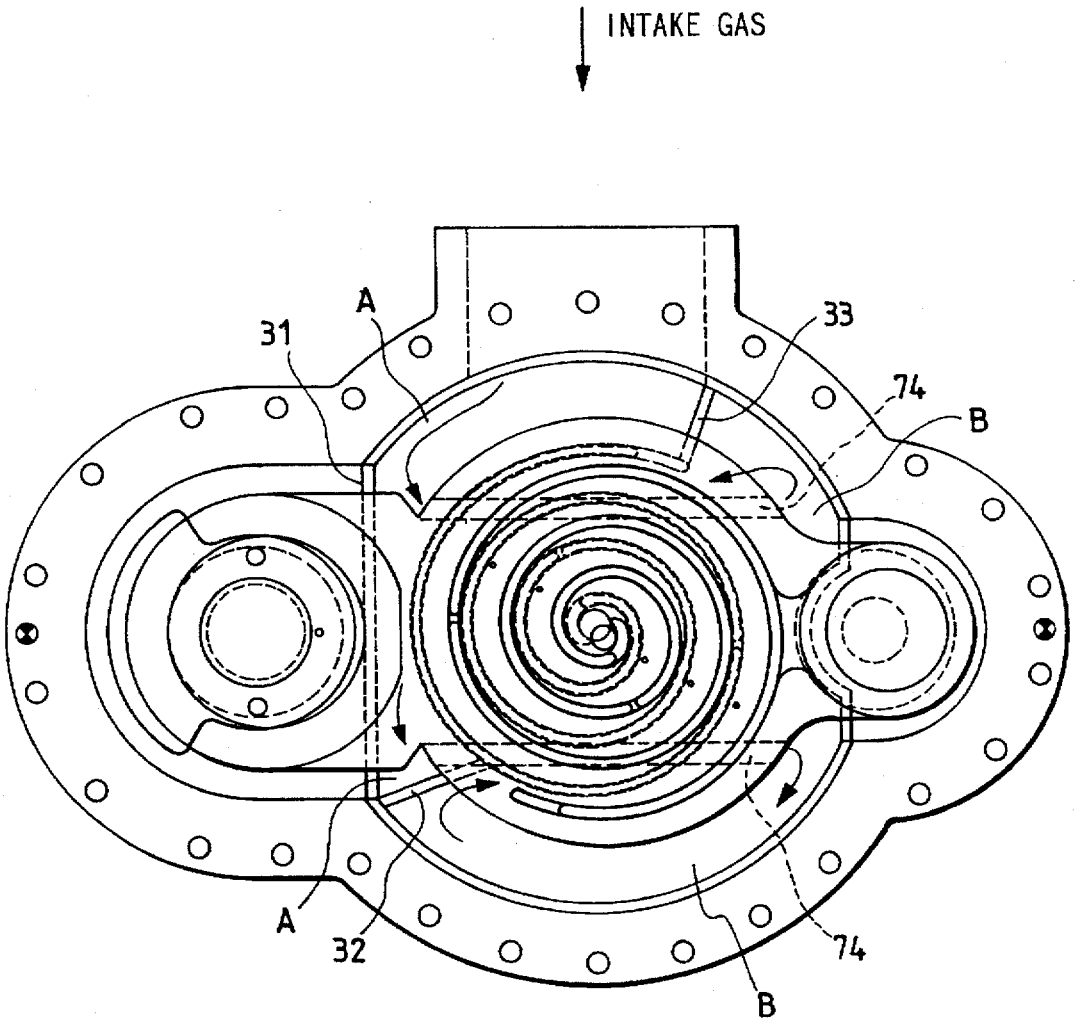
FIG. 11 is a view corresponding to FIG. 3 illustrating the structure of partition plates in the modification example of FIG. 10.

FIG. 10 shows a revolving scroll wherein two cooling holes 74 are provided in the transverse direction in a mirror plate 3*a* of a revolving scroll. When cooling holes are provided as shown in FIG. 10, for example, partitions 31, 32 and 33 are provided so that intake air flows from left to right as shown in FIG. 11. If this construction is adopted, intake air flowing through the cooling holes 74 flows into both intake sides of the scroll compressor and consequently it is possible to increase the amount of cooling air flowing through the cooling holes.

In the preferred embodiments described above, the revolving scroll is cooled by the scroll compressor's own intake air; however, if another cooling fluid from outside (for example outside air or cooled, low-temperature air) is forcibly made to flow through cooling holes formed in the revolving scroll as a direct-cooling fluid, the cooling effect can be increased even further.

Figure 13:
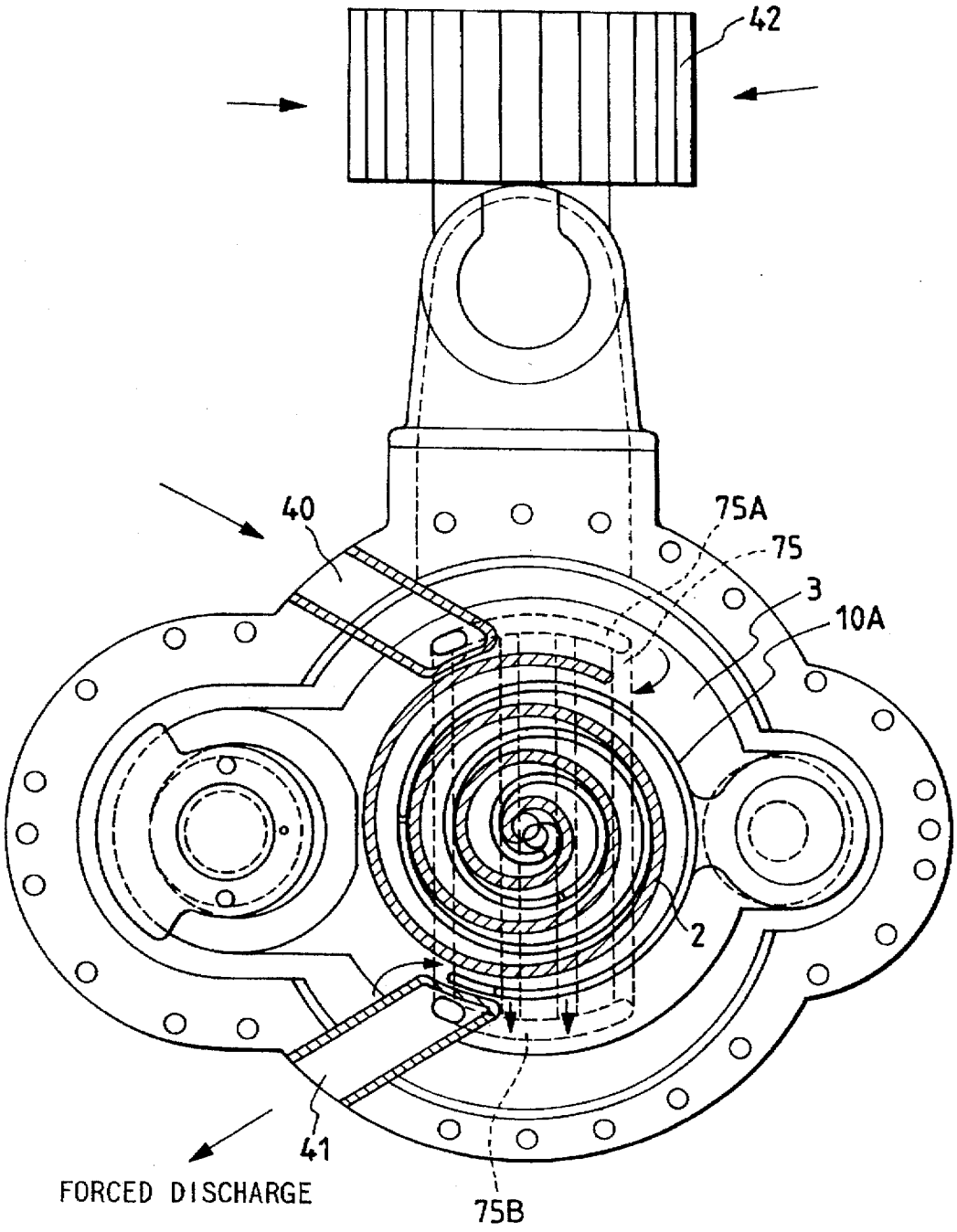
FIG. 13 is a sectional view of another preferred embodiment of the invention as seen in a direction corresponding to the direction of the arrows III—III of FIG. 1.

Another preferred embodiment is shown in FIG. 13.

Figure 17:
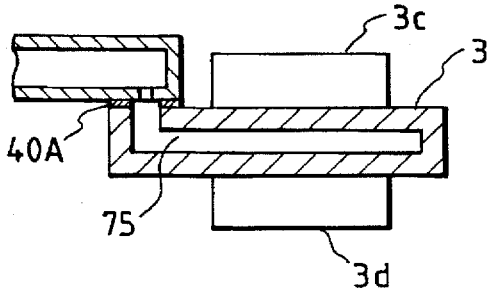
FIG. 17 is an outline sectional view illustrating the relationship between a revolving scroll and an external cooling passage.

In FIG. 13, the hatched areas are cross-sections of a right fixed scroll 2 and a revolving scroll 3 is not in section in order to show its tip portion clearly. At least one and in the example shown in FIG. 13 four cooling passages 75 are provided in the trunk or end plate of the revolving scroll 3 substantially parallel with the faces of the trunk plate. The ends of these cooling passages 75 are connected to an inlet connecting passage 75A and an outlet connecting passage 75B each having an opening at a face of the trunk plate, and the opening of the inlet connecting passage 75A is connected to an external inlet cooling passage 40 provided in the right fixed scroll 2 byway of a seal member 40A shown in FIG. 17. As a result, while being kept separate from the fluid being compressed, a fluid for cooling can flow through the external inlet cooling passage 40 into the cooling passages 75 in the revolving scroll 3 and be discharged through the outlet connecting passage 75B to outside the scroll compressor through an external outlet cooling passage 41 having a similar construction to that of the external inlet cooling passage 40. In this way, the revolving scroll 3 is cooled. Because the passages for cooling are separate from the passages for the air being compressed, even if dust or the like gets into air that is the fluid for cooling, the air being compressed is not dirtied. In FIG. 13, reference numeral 42 denotes a filter.

Figure 14:
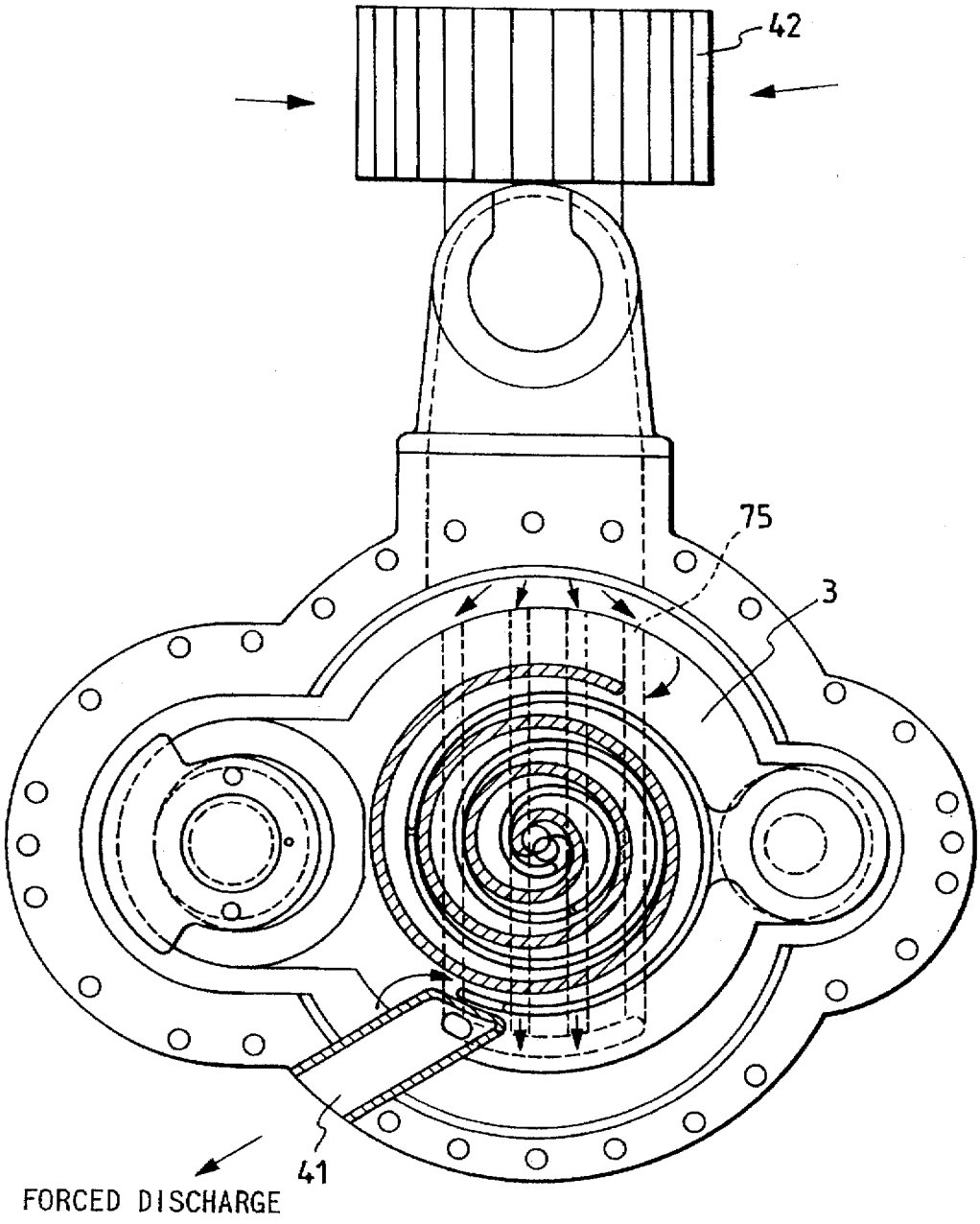
FIG. 14 to FIG. 16 are views corresponding to FIG. 13 showing modification examples of the preferred embodiment shown in FIG. 13.

FIG. 14 shows a modification example of the preferred embodiment shown in FIG. 13, and in this drawing also the hatched areas are cross-sections of a right fixed scroll. Cooling passages 75 are provided in a revolving scroll 3. In the example shown in FIG. 14, an external inlet cooling passage and an inlet connecting passage are dispensed with but an external outlet cooling passage 41 and an outlet connecting passage are provided. Some of the air to be compressed having passed through an intake filter 42 flows into the cooling passages 75 which have openings in the circumferential peripheral surface or a face of the trunk plate, passes through the outlet connecting passage and is discharged through the external outlet cooling passage 41. At this time, the outlet of the outlet connecting passage and the external outlet cooling passage 41 are connected by way of a seal member similar to the seal member 40A shown in FIG. 17, and fluid for cooling having risen in temperature is thereby prevented from mixing with the air being compressed. With this preferred embodiment, because no external inlet cooling passage or inlet connecting passage is required, the construction can be simplified.

Figure 15:
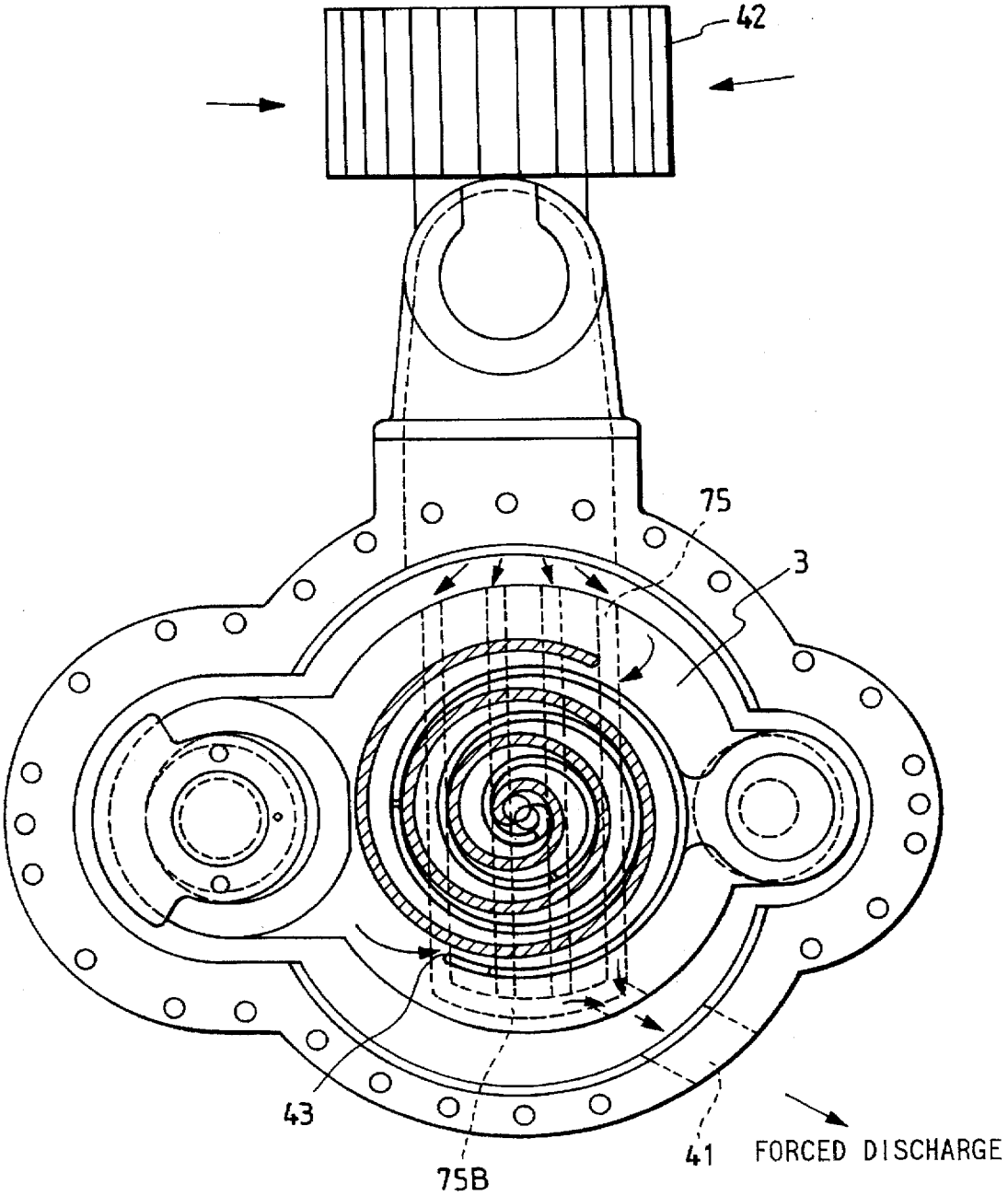

FIG. 15 also shows a modification example of the preferred embodiment shown in FIG. 13, and in this drawing also the hatched areas are cross-sections of a right fixed scroll. Cooling passages 75 are provided in a revolving scroll 3, and an outlet connecting passage 75B is connected to the cooling passages 75. Some of the air to be compressed having passed through an intake filter 42 flows into the cooling passages 75 and the outlet connecting passage 75B and is discharged through an external outlet cooling passage 41. In this embodiment, the opening of the outlet connecting passage 75B connected to the cooling passages 75 is not directly connected to the external outlet cooling passage 41, and fluid for cooling having cooled the revolving scroll and consequently risen in temperature is prevented from mixing with the air to be compressed by these two passages being disposed near each other and disposed in a position remote from the scroll lap intake starting position 43. In this preferred embodiment, inlet and outlet connecting passages like those in the preferred embodiments described above are dispensed with and the construction is therefore simpler.

Figure 16:
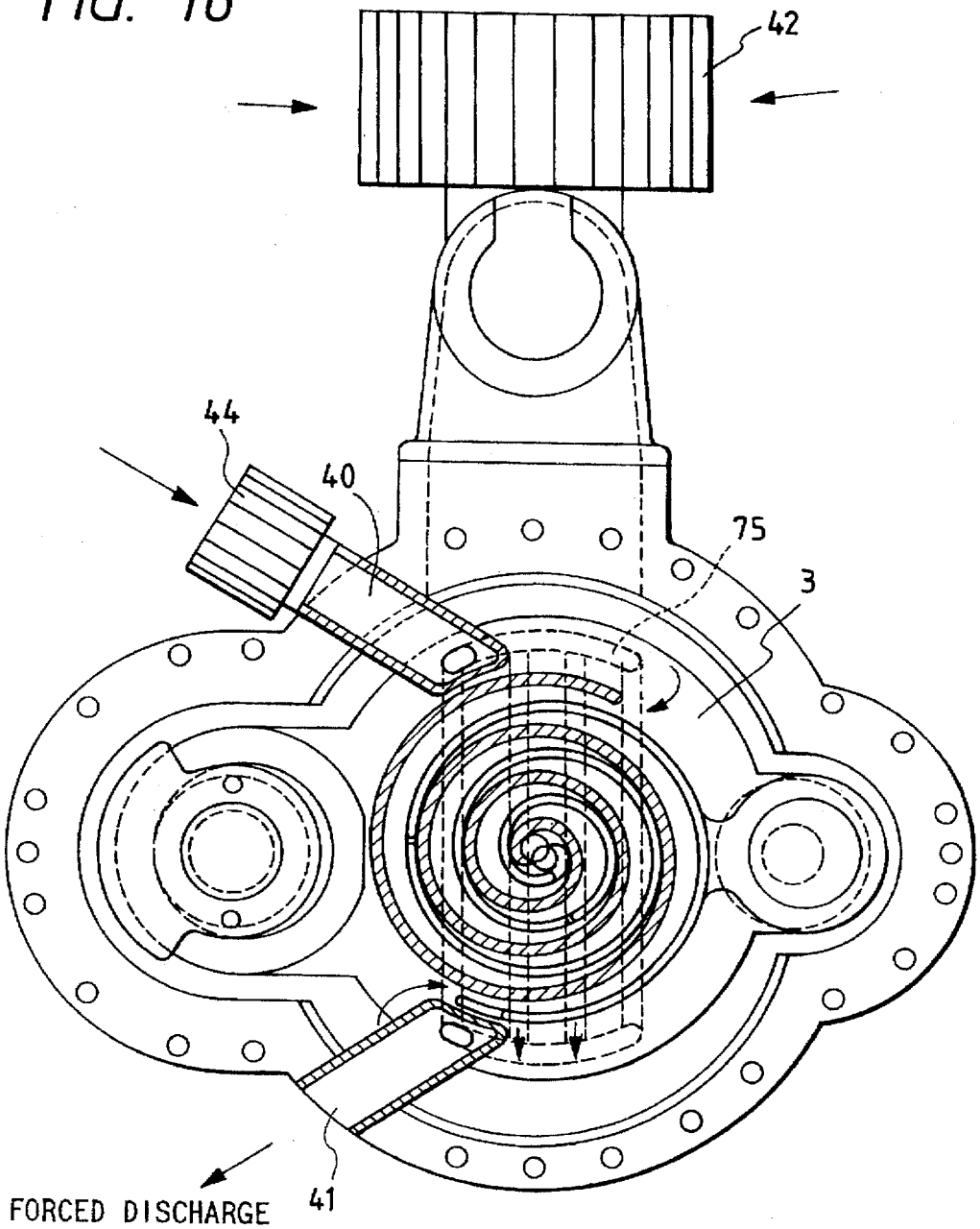

FIG. 16 shows a modification example of the preferred embodiment shown in FIG. 13 wherein a filter 44 corresponding to the intake filter 42 is provided in the external inlet cooling passage 40. With this preferred embodiment, dust is removed from the air for cooling by the filter 44 so that if cooling air leaks from the cooling passage, dust does not get between the scroll laps.

Some of the benefits provided by the preferred embodiments described above are as follows:

(1) By means of the cooling holes formed in the mirror plate of the revolving scroll, even when it is not possible to cool the revolving scroll from outside using cooling fins or the like, the revolving scroll can be directly cooled from the inside and the temperature of the revolving scroll can be reduced. As a result, it is possible to make the gaps formed between the fixed scrolls and the revolving scroll smaller and the performance of the compressor can be improved.

(2) It is possible to reduce the discharge air temperature of the compressor, cooling of the delivered air becomes easy and the reliability of the compressor can be increased.

(3) In a compressor of which the fixed scrolls are provided with radiating fins, the fixed scrolls can be efficiently cooled from the outside.

(4) Because it is also possible to reduce the temperature of tip seals provided on the tip surfaces of the laps of an oil-less double scroll compressor, selection of the material of the tip seals becomes easier and their life with respect to wear can be increased. If the mirror plate of the revolving scroll is provided with pressure-equalizing holes for connecting the compression chambers on either side of the mirror plate and balancing their pressures, the thrust forces acting on the revolving scroll are balanced better and as a result the loads acting on the tip seals are also reduced and their life can be extended in this way also.

What is claimed is:

1. A scroll compressor comprising an orbiting scroll having a spiral-shaped lap formed on an end plate and a fixed scroll having a spiral-shaped lap meshing with the lap formed on the end plate, wherein the end plate has a cooling hole passing therethrough from one peripheral side of the end plate to another and at least some intake gas of the scroll compressor passes through the cooling hole before being sucked into a compression chamber through an intake end of the spiral-shaped laps.

2. A scroll compressor according to claim 1 wherein the end plate has a plurality of pressure-equalizing holes for connecting together compression chambers formed on either side of the end plate whereby thrust forces exerted by gas pressures inside the compression chambers on each side of the end plate are balanced.

3. A scroll compressor according to claim 1 wherein tip seals are provided on end portions of the spiral-shaped laps of the fixed and orbiting scrolls.

4. A scroll compressor according to claim 1 wherein the cooling hole passes through the vicinity of a central portion of the orbiting scroll.

5. A scroll compressor according to claim 1 wherein the cooling hole has a chrysanthemum shaped cross-section.

6. A scroll compressor comprising an orbiting scroll having a lap surface on either side of an end plate, a fixed scroll disposed on either side of the orbiting scroll and a drive shaft and an auxiliary crankshaft for revolving the orbiting scroll and rotatably supported by the fixed scrolls, wherein the end plate has a cooling hole passing therethrough from one peripheral side of the end plate to another through which at least some intake gas of the scroll compressor passes.

7. A scroll compressor according to claim 6 wherein the end plate has a plurality of cooling holes provided in parallel relationship to one another.

8. A scroll compressor according to claim 6 wherein the end plate has a plurality of longitudinal cooling holes provided in parallel in a longitudinal direction and a plurality of transverse cooling holes connecting together the longitudinal cooling holes provided in a transverse direction.

9. A scroll compressor according to claim 6 wherein the end plate has a plurality of cooling holes formed diagonally rising to the right and a plurality of cooling holes formed diagonally rising to the left whereby they mutually intersect and mutually connect where they intersect.

10. A scroll compressor comprising an orbiting scroll having a spiral-shaped lap disposed on either side of an end plate, left and right fixed scrolls disposed on either side of the orbiting scroll and each having a spiral-shaped lap meshing with a lap of the orbiting scroll, a drive shaft and an auxiliary crankshaft for revolving the orbiting scroll and rotatably supported by the left and right fixed scrolls by bearings and a timing belt for causing the drive shaft and the auxiliary crankshaft to rotate synchronously, wherein the end plate has a cooling hole passing therethrough from one peripheral side of the end plate to another through which at least some intake gas of the scroll compressor passes and cooling fins are formed on outer surfaces of the left and right fixed scrolls and extending in a direction connecting the drive shaft and the auxiliary crankshaft and a cooling fan for causing a cooling medium to flow over the cooling fins.

11. A scroll compressor comprising:

a scroll compressor member including an orbiting scroll having a lap surface on either side of an end plate, a fixed scroll disposed on either side of the orbiting scroll and a drive shaft and an auxiliary crankshaft for revolving the orbiting scroll and rotatably supported by the fixed scrolls;

a motor for driving the scroll compressor member by a V-belts a controller for controlling the motor;

a delivery pipe for guiding gas discharged from the scroll compressor member to the outside and, disposed in the delivery pipe in the following order from the upstream side, a nonreturn valve, a precooler and an aftercooler;

a cooling fan for cooling at least one of the motor, the scroll compressor member, the non-return valve, the precooler and the aftercooler;

a casing for housing the motor, the scroll compressor member, the non-return valve, the precooler and the aftercooler; and wherein the and plate has a cooling hole passing therethrough from one peripheral side of the end plate to another and at least some intake gas of the scroll compressor passes through the cooling hole before being sucked into a compression chamber formed between the fixed scrolls and the orbiting scroll.

12. A scroll compressor comprising an orbiting scroll having a lap surface on either side of an end plate, a fixed scroll disposed on either side of the orbiting scroll and a drive shaft and an auxiliary crankshaft for revolving the orbiting scroll and rotatably supported by the fixed scrolls, wherein the end plate has a connecting hole formed near the center thereof for connecting together compression chambers formed on either side of the end plate and a cooling hole passing through the end plate from one peripheral side of the end plate to another through which at least some intake gas of the scroll compressor passes.

13. A scroll compressor comprising an orbiting scroll having a lap surface on either side of an end plate, a fixed scroll disposed on either side of the orbiting scroll and a drive shaft and an auxiliary crankshaft for revolving the orbiting scroll and rotatably supported by the fixed scrolls, wherein the end plate has a connecting hole formed near the center thereof for connecting together compression chambers formed on either side of the end plate and a cooling hole passing through the end plate from one peripheral side of the end plate to another through which at least some intake gas of the scroll compressor passes, and there is provided a partition for separating a first intake space at an inlet end of the cooling hole and a second intake space at an outlet end of the cooling hole.

14. A double scroll compressor for compressing a fluid sucked in through an inlet port by means of eccentric motion of an orbiting scroll, comprising an orbiting scroll having a lap surface on either side of an end plate, a fixed scroll disposed on either side of the orbiting scroll and a drive shaft and an auxiliary crankshaft for revolving the orbiting scroll and rotatably supported by the fixed scrolls, wherein the end plate has a cooling hole passing therethrough from one peripheral side of the end plate to another through which at least some intake gas of the scroll compressor passes.

15. A scroll compressor comprising an orbiting scroll having a lap surface on either side of an end plate, a fixed scroll disposed on either side of the orbiting scroll and a drive shaft and an auxiliary crankshaft for revolving the orbiting scroll and rotatably supported by the fixed scrolls, wherein the end plate has a cooling hole passing therethrough in a transverse direction and through which at least some intake gas of the scroll compressor passes, and there is provided a partition for separating a first intake space at an inlet end of the cooling hole and a second intake space at an outlet end of the cooling hole.

16. A double scroll compressor comprising an orbiting scroll having a scroll lap on either side of an end plate and a fixed scroll on either side of the orbiting scroll for compressing a fluid sucked in through an inlet port by means of eccentric motion of the orbiting scroll, wherein the end plate of the orbiting scroll has a cooling passage and a separate intake passage is provided leading from outside the orbiting scroll to the orbiting scroll and isolated from intake fluid to be compressed and wherein by passing a fluid for direct cooling through the cooling passage, cooling of the orbiting scroll is carried out and the fluid for direct cooling is discharged to outside the orbiting scroll by means of a separate outlet passage isolated from the intake fluid.

17. A scroll compressor according to claim 16 wherein a filter is provided at the inlet of the cooling passage.

18. A scroll compressor according to claim 16 comprising a plurality of passages for cooling fluid.

19. A scroll compressor comprising an orbiting scroll having a scroll lap on either side of an end plate and a fixed scroll on either side of the orbiting scroll for compressing a fluid sucked in through an inlet port by means of eccentric motion of the orbiting scroll, wherein the end plate of the orbiting scroll has a cooling passage and some of a fluid taken in from outside the scroll as intake fluid to be compressed is passed through the cooling passage to cool the orbiting scroll and fluid thus used for cooling is discharged to outside the orbiting scroll by means of a separate outlet passage isolated from the intake fluid to be compressed.

20. A scroll compressor comprising an orbiting scroll having a scroll lap on either side of an end plate and a fixed scroll on either side of the orbiting scroll for compressing a fluid sucked in through an inlet port by means of eccentric motion of the orbiting scroll, wherein the end plate of the orbiting scroll has a cooling passage and some of a fluid taken in from outside the scroll as intake fluid to be compressed is passed through the cooling passage to cool the orbiting scroll and fluid thus used for cooling is isolated from the intake fluid to be compressed, and wherein a passage for discharging to the outside and the cooling passage in the orbiting scroll are disposed close to each other and isolated from an intake position of the fixed scroll to prevent the reuse of the intake fluid that has been used for cooling and to discharge fluid having risen in temperature to the outside.

* * * * *